United States Patent [19]

Koerber et al.

[11] Patent Number: 4,960,430

[45] Date of Patent: Oct. 2, 1990

[54] METHOD FOR MANUFACTURING OF MAT AND ROUGH, LAMINAR, RIBBON-SHAPED OR FIBROUS POLYMERIC PRODUCTS WITH A STREAM OF PARTICLES

[75] Inventors: Heinz Koerber; Rudolf Hanke; Helmar Paessler; Bernd Kessler; Manfred Raetzsch; Adolf Heger, all of Dresden; Karlheinz Kolletzky, Greiz, all of German Democratic Rep.

[73] Assignee: Veb Greika Greiz Weberei und Veredlung, Greiz, German Democratic Rep.

[21] Appl. No.: 186,323

[22] Filed: Apr. 26, 1988

[51] Int. Cl.[5] ..... B24C 1/06; D06Q 1/00

[52] U.S. Cl. ..... 8/114; 8/114.6; 8/498; 8/499; 8/506; 427/108; 427/195; 427/369

[58] Field of Search ..... 8/498, 499, 114

[56] References Cited

U.S. PATENT DOCUMENTS

| | | | |
|---|---|---|---|
| 3,032,889 | 5/1962 | Chipalkatti et al. | 34/57 A |
| 3,472,430 | 10/1969 | Quackenbush et al. | 406/136 |
| 3,503,778 | 3/1970 | Corbett et al. | 427/195 |
| 3,994,683 | 11/1976 | Zimmer et al. | 8/498 |
| 4,551,191 | 11/1985 | Kock et al. | 156/276 |
| 4,717,391 | 1/1988 | Daniel et al. | 8/489 |

FOREIGN PATENT DOCUMENTS

| | | | |
|---|---|---|---|
| 291026 | 11/1988 | European Pat. Off. . | |
| 2515105 | 10/1975 | Fed. Rep. of Germany | 8/498 |
| 83/04195 | 12/1983 | PCT Int'l Appl. . | |
| 999646 | 7/1965 | United Kingdom | 8/498 |
| 1567036 | 5/1980 | United Kingdom . | |
| 2047126 | 11/1980 | United Kingdom . | |

*Primary Examiner*—A. Lionel Clingman
*Attorney, Agent, or Firm*—Jordan and Hamburg

[57] ABSTRACT

Mat and rough endless sheetlike, ribbon-shaped or filiform polymeric products, preferably natural-fiber-like mat and rough textile products of chemical fiber materials, in particular of synthetic fiber materials, or mat and rough polymer films with low transparency are produced by contacting endless sheetlike, ribbon-shaped or filiform polymeric products with fine particles of organic or inorganic solid matter. This gives the textile structures a rough, woolly, soft feel and they are mat, while films become rough and mat and have a low transparency.

2 Claims, 2 Drawing Sheets

METHOD FOR MANUFACTURING OF MAT AND ROUGH, LAMINAR, RIBBON-SHAPED OR FIBROUS POLYMERIC PRODUCTS WITH A STREAM OF PARTICLES

BACKGROUND OF THE INVENTION

This invention relates to a method of producing mat and rough sheetlike, ribbon-shaped or filiform polymeric products, preferably natural-fiber-like mat and rough textile products of chemical fiber materials, in particular of synthetic fiber materials or mat and rough polymer films having little transparency.

Synthetic fiber materials are distinguished from natural fiber materials by a variety of outstanding useful properties. Polyester and polyamide fiber materials occupy a preeminent positoin among synthetic fiber materials. The individual filaments of these two fiber materials are cylindrical and have a smooth surface (except for the small percentage of total production of profiled monofilaments spun with special dies). As a result, these fiber materials and the products made of them look glossy and feel smooth or soapy or greasy to the touch. Even fiber materials delustered in spinning still have a considerable gloss. In contrast thereto, sheetlike structures of natural fiber materials, especially of wool and cotton, have a mat appearance and a rough or woolly feel.

These differences in gloss and feel are particularly evident in the comparison of sheetlike structures of polyester or polyamide monofilaments with sheetlike structures of wool or cotton. Sheetlike structures of polyester fibers, on the other hand, come closer to natural fiber products in these properties. Variations in shape of polyester and polyamide fiber materials in the macroscopic range, for example, due to crimping or texturizing, result only in a minimal approximation to the dullness and feel of natural fiber materials. The same is true for fiber materials spun with profiling dies. Even in profiled monofilaments, the surface regions of individual filaments, reflecting light in one direction, are still too great to eliminate glossy effects. Crimping or texturizing does indeed make the filament and hence the sheetlike structure bulkier and softer; the smooth, soapy feel, however, is not appreciably influenced.

Roughening, abrading and methods derived therefrom are used in sheetlike structures of synthetic filaments to break individual filaments, usually in a special filamentary system, so that the broken ends project from the surface of the sheet and form a fibrous web. These broken ends, for one thing, produce a diffuse reflection of light, which imparts to the sheetlike structures a mat appearance, and, for another, they result in a soft woolly feel. However, the resultant velvety texture is only of interest for specific fields of application. In addition, these treatments require certain constructions of sheetlike structures; for example, smooth tight fabrics cannot be treated in this way. The low gloss and the woollier feel of sheetlike structures of yarns can be attributed to the filament ends projecting from the fibrous web. On the one hand, gloss and feel of textile sheetlike structures are properties dictated by fashion. On the other hand, high-quality textile products are generally considered to be those made of natural fiber materials.

The development of chemical fiber materials and their modification was and is, therefore, oriented toward the production of fiber materials and products which combine the new, useful properties with the tried-and-true, and traditional, properties of natural fiber materials. The demand for approximation of gloss and feel of synthetic fiber materials to those of natural fiber materials should be seen from this point of view.

Polymeric films, for instance of polyester, polyamide, polyethylene or triacetate, have smooth, in some cases glossy surfaces and a high transparency. These properties are disadvantageous for a variety of fields of application. It is known that films of limited size may be roughened on a vibrating table by scattered sand. This method, however, has the disadvantage that continuous roughening of endless webs or bands of polymeric film is not possible. In addition, it is known that structured film surfaces may be obtained by embossing with rolls which have a surface corresponding to the embossed pattern. However, gloss, feel and transparency of the films are not very much influenced thereby. According to one known method, a surface roughness may alternatively be obtained by addition of suitable material to coatings, e.g., by addition of rice starch to gelatine. This method, however, has the disadvantage that it is associated with coating of the sheet.

An object of the invention is to make chemical fiber materials, in particular synthetic fiber materials, more natural-fiber-like with respect to gloss and feel, whereby textile products produced from chemical fiber materials become higher in quality and polymeric films are made rough, mat and less transparent.

A further object of the invention is to produce, in novel fashion, chemical fiber materials having natural-fiber-like feel and gloss and mat, rough polymer films having little tranparency.

SUMMARY OF THE INVENTION

According to the invention, the aforementioned objects are accomplished in that sheetlike, ribbon-shaped or filiform polymeric products are acted upon by fine particles of organic or inorganic solid matter. It is advantageous to project the particles of solid matter onto continuously moving, endless sheetlike, ribbon-shaped or filiform polymeric products mechanically or by a stream of gas or liquid. Sand, corundum, glass or metal particles, preferably with a particle size of from 0.1 to 2 mm, may be used as the particles of solid matter. In this connection, the individual particles of solid matter may consist of a homogeneous substance or of a plurality of substances. Alternatively, mixtures of a variety of particles of solid matter may be used. The particles of solid matter may consist entirely or partially of substances some of which upon impact are transferred to the sheetlike, ribbon-shaped or filiform polymeric products.

Alternatively, the invention may be effected by conducting the endless, sheetlike, ribbon-shaped or filiform polymeric products through stationary or agitated particles of solid matter. The sheetlike, ribbon-shaped or filiform polymeric products may alternatively be acted upon in the swollen state. It is advantageous to apply preparatory agents to the sheetlike, ribbon-shaped or filiform polymeric pruducts, or to dye or to imprint or to coat them, before acting on them with particles of solid matter. It is of particular advantage to carry out said action at a temperature of from 15° C. to the softening temperature of the respective polymer.

Such sheetlike, ribbon-shaped or filiform polymeric products thus treated are mat and rough compared with the untreated materials. Textile materials of synthetic fiber materials are given a soft, woolly feel by the treatment and become more like natural fiber materials. in addition, the treatment of textile sheetlike structures produces a more even lay of the filaments; a more uniform and tighter appearance of the fabric is obtained. Additionally, treated polymeric films are less transparent. The method is alternatively suitable for treating non-polymeric films, for instance for roughening the surface and for reducing the gloss of aluminum foils.

DESCRIPTION OF PREFERRED EMBODIMENTS

The invention is explained in detail below, by means of several examples:

EXAMPLE 1

Figure 1:
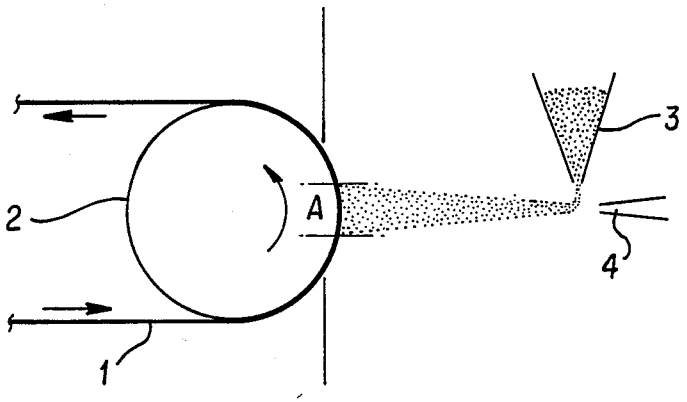
FIG. 1 is a schematic of a first embodiment of apparatus for carrying out the method of the invention.

According to FIG. 1, an undyed fabric of polyester filaments having a weight per unit area of 60 g/m$^2$ and a width of 1 m is carried over a rotating drum 2 and impacted in zone A by corundum particles of 0.5 mm particle size. The corundum particles are supplied by way of a 1 m wide feed tank 3 and accelerated by a stream of air emerging from a 1 m wide jet 4. The air is at ambient temperature. Owing to the treatment, the fabric becomes mat and rough to the touch on the side impacted by corundum particles. In addition, it becomes softer and tighter, and the lay of the filaments becomes more even.

EXAMPLE 2

Figure 2:
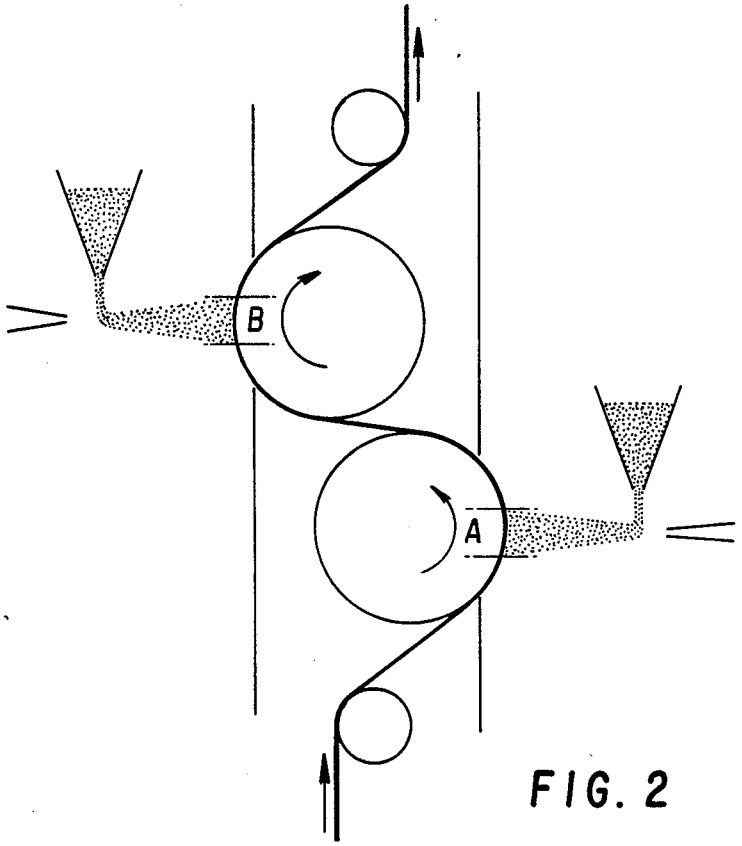
FIG. 2 is a schematic of a second embodiment of apparatus for carrying out the method of the invention.

A polyester film 1 m wide and 40 μm thick is first treated on one side as in Example 1 but in zone A of the apparatus of FIG. 2 and the impacting is by tiny glass balls 0.1 mm in diamter. The other side of the film is then treated in like fashion in zone B (FIG. 2). Owing to this treatment, the film becomes mat and rough on both sides, and its transparency is reduced.

EXAMPLE 3

A dyed polyamide filaments fabric, coated on one side, is first acted on, on the coated side in the region A (FIG. 2) with quartz sand particles of 1.5 mm in size. Then it is impacted on the uncoated side in region B (FIG. 2) by quartz sand of 0.7 mm particle size (FIG. 1). This two-sided treatment makes the fabric softer, rough and mat. Its impermeability to water owing to the coating is retained.

EXAMPLE 4

An undyed polyester knitted fabric is treated as in Example 1. However, it is impacted by quartz sand particles 0.5 mm in size, which have previously been treated in a dispersion of disperse dye and then dried. Acceleration of the particles is effected with hot air of 190° C. The effects mentioned in Example 1 are obtained and, in addition, the knitted fabric is dyed.

EXAMPLE 5

An undyed polyester knitted fabric is treated as in Example 1. However, it is impacted with a mixture of quartz sand particles and disperse dye granulate (ratio of mixture 1:10). Acceleration of the particles is effected with air of ambient temperature. Dye is fixed on the knitted fabric by the known thermal after-treatment. This treatment results in the effects mentioned in Example 4.

EXAMPLE 6

Figure 3:
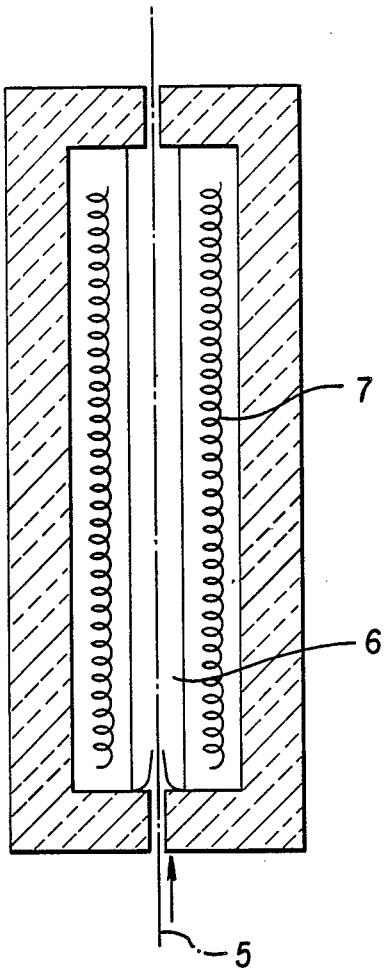
FIG. 3 is a schematic of a third embodiment of apparatus for carrying out the method of the invention.

A polypropylene filament 5 (FIG. 3) is conducted through the chamber 6, filled with quartz sand particles of 0.7 mm particle size. The sand particles are heated to 125° C. by heating jacket 7. The filament is given a fine-pebbled surface by this treatment, owing to which it becomes mat and rough.

It was surprising that this treatment does not disturb the sheet-like, ribbon-shaped or filiform polymeric products either in whole or in part, but only alters the surface of the polymeric products.

We claim:

1. Method of treating a synthetic polymeric product in the form of a sheet, strand or filaments to render a surface thereof mat or rough, comprising impacting the surface at a temperature of from 15° C. to the softening point of the polymer with 0.1 to 2 mm size particles of sand, glass, corundum or a metal, said impacting being effected by directing onto the surface a stream of gas carrying the particles.

2. Method according to claim 1, in which the impacting is effected while transporting the product continuously through an impacting zone.

* * * * *